US005340099A

United States Patent [19]

Romanenko et al.

[11] Patent Number: 5,340,099

[45] Date of Patent: Aug. 23, 1994

[54] ORIENTATION CHUTE FOR SORTING MACHINE

[75] Inventors: Michael Romanenko, South Elgin; Robert E. Sadler, Jr.; John M. Buday, Jr., both of Des Plaines, all of Ill.

[73] Assignee: ElectroCom GARD Ltd., Niles, Ill.

[21] Appl. No.: 983,090

[22] Filed: Nov. 20, 1992

[51] Int. Cl.[5] ..... B65H 39/10; B07C 9/00

[52] U.S. Cl. ..... 271/303; 271/305; 193/8; 198/367; 209/657; 209/900

[58] Field of Search ..... 198/360, 367, 369; 271/184, 185, 303, 305; 193/8, 46, 48; 209/540, 544, 641, 651, 657, 900

[56] References Cited

U.S. PATENT DOCUMENTS

| | | | |
|---|---|---|---|
| 762,940 | 6/1904 | Poignant | 193/46 X |
| 2,937,739 | 5/1960 | Levy | 271/305 X |
| 3,137,499 | 6/1964 | Maidment | 271/305 X |
| 4,047,712 | 9/1977 | Burkhardt et al. | 209/900 X |
| 4,077,620 | 3/1978 | Frank et al. . | |
| 4,147,252 | 4/1979 | Burkhardt | 209/900 X |
| 4,527,792 | 7/1985 | Burkhardt . | |

FOREIGN PATENT DOCUMENTS

| | | | |
|---|---|---|---|
| 2425280 | 1/1980 | France | 193/8 |

*Primary Examiner*—Robert P. Olszewski
*Assistant Examiner*—Tuan N. Nguyen
*Attorney, Agent, or Firm*—Hill, Steadman & Simpson

[57] ABSTRACT

An orientation chute is provided for a sorting machine which has a horizontal conveyor. The chute positively guides the objects as they leave the conveyor such that the relative orientation of successive objects leaving the container is maintained as the objects are deposited at a point of collection. A curved panel is used to intercept the objects as they leave the conveyor and to redirect them toward a stop member which stops their horizontal inertial velocity. The panel is sloped from the vertical to balance gravitational and centrifugal forces to maintain the object essentially horizontally as it moves across the panel. Once the object is stopped, it falls under the force of gravity along a slide portion of the chute to be deposited in a collection container.

14 Claims, 3 Drawing Sheets

ORIENTATION CHUTE FOR SORTING MACHINE

BACKGROUND OF THE INVENTION

The present invention relates to delivery chutes and in particular to a delivery chute for use in a sorting machine having a horizontal conveyor.

Horizontal conveyor sorting machines are well known and are described in such patents as U.S. Pat. Nos. 4,077,620, 4,147,252 and 4,527,792.

A particular use for such sorting machines is to sort pieces of mail, including mail referred to as "flats" which generally are envelopes and magazines having a large height and width as compared to their thickness.

In some such mail sorting machines there are up to 100 discharge outputs from the machine as the objects are sorted as they move along a horizontal conveyor. Two machines utilized in particular are referred to as the FSM881 and the FSM775 by the United States Postal Service.

Discharge chutes are provided on these sorting machines to guide the flat to a stationary container positioned below each discharge chute. The chutes, however, do not positively guide and orient the flat, but only provide a guided free fall of the flat after it has been diverted from the conveyor. The only constant is the entering velocity of the flat which is approximately 72 inches per second. Variables affecting the movement of the flat after it has been diverted from the conveyor include the weight, size, aspect ratio, static electricity, surface friction effects against the chute, stiffness of the flat and aerodynamic characteristics of the flat. Even the effects of humidity may change the coefficient of friction of the flat. Considering these variables, different trajectories and rotations occur along the chute path. The chute itself is a short spiral sheet, curving and descending along a vertical axis.

An intercepting diverter is provided at each discharge station, positioned near the bottom of the conveyor channel in which the flats are carried. Generally the diverter is positioned below transport push rods which push the individual flats along the fixed support surfaces of the conveyor. When the diverter is rotated in toward the feed path, the next flat is forced to turn through a small angle toward the guide chute. The diverter imparts a retarding force to the flat, and since the flat center of gravity generally is above the diverter, a torque is applied to the flat, beginning a rotation. A secondary effect occurs as the flat leaves the transport and moves off of the horizontal supporting surface of the conveyor. The leading edge of the flat is no longer supported, allowing it to fall and causing rotation of the flat. The rotational energy imparted to the flat is a function of the length of the flat, its weight and velocity. The analysis of rotation concludes that the significant parameter is the aspect ratio of the flat dimensions (height to length). Flats with small aspect ratios (height exceeding length) will have a smaller rotational velocity. This analysis assumes the center of gravity of the flat coincides with the center of area.

As the flat falls along the chute, its contact with the chute also affects the rotation of the flat, but probably in an indeterminate way, allowing for the variability of the flat characteristics. The curve in the chute increases the normal contact force due to centripetal effects, increasing drag and slowing the velocity of the flat. The aforementioned factors result generally in an unedged, disheveled stack of flats, many with loss of the original orientation on the transport path. The flats are discharged from the chute approximately 90° from their direction of travel along the conveyor and are received in rectangular boxes which are set on the floor spaced laterally from the conveyor to accommodate the lateral movement of the flat moving along the chute and its airborne travel after leaving the chute. A distant edge of the box is required to be elevated to prevent or reduce over shooting of the box by the airborne flats.

It would be advantageous, therefore, to provide a transport chute which maintains the orientation of objects diverted from a horizontal conveyor such that all of the objects deposited into the output stack will have the same orientation to each other as they did on the horizontal conveyor.

SUMMARY OF THE INVENTION

The present invention provides a discharge chute for a horizontal conveyor which will positively direct objects diverted from the conveyor and guide them to a point of collection where they will be deposited in a consistent orientation relative to their orientation on the conveyor. This discharge chute also permits a more compact placement of the collection boxes relative to the conveyor.

The chute includes a bottom edge guide plate which is positioned adjacent to the diverter plate to provide vertical support for the object for a short distance after diversion from the conveyor occurs. A curved and sloped panel is provided to intercept the object which has been diverted from the conveyor. Along a lateral outboard edge of the curved panel is an end stop which will arrest the horizontal movement of the object. This end stop, in some embodiments, may include an energy absorbing device such as a cushion pad. A short length discharge slide extends from the lower edge of the curved panel to direct the objects vertically and horizontally to the point of collection. The objects are deposited at the point of collection by moving in a direction approximately 180° from their direction of travel on the conveyor.

DETAILED DESCRIPTION OF THE PREFERRED EMBODIMENTS

Figure 1:
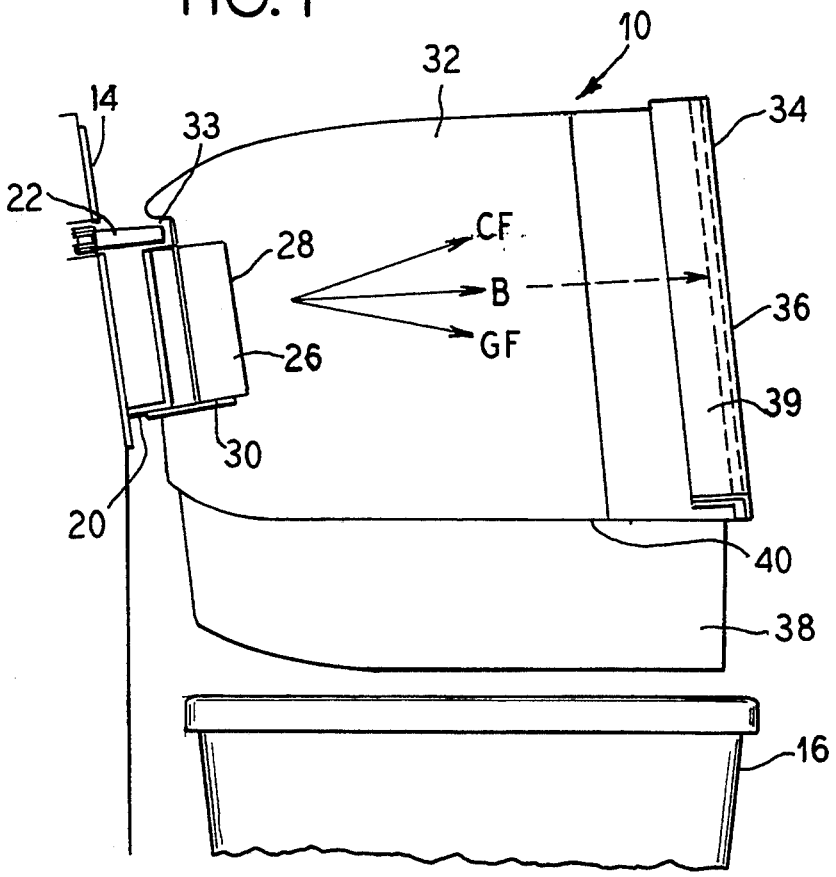
FIG. 1 is an end elevational view of a horizontal conveyor incorporating an orientation chute according to the principles of the present invention.

In the FIGURES there is illustrated a chute generally at 10 for directing objects such as an envelope 12 as it is diverted from a horizontal conveyor 14 to a collection bin 16. Although an envelope is illustrated, the invention is not limited to use with envelopes, or even mail flats. The invention can be used with any horizontal conveyor which is conveying objects having a relatively flat bottom edge and a height and width greater than a thickness, as carried along the conveyor.

A conveyor with which this invention has particular utility has a fixed horizontal support surface 20 along which the objects 12 slide as they are pushed by a pusher finger 22. A diverter plate or gate 24 is selectively pivotable into the feed path of the conveyor 14 to divert one of the objects 12 being transported on the conveyor. The object 12 is diverted at a small angle to the flow path on the conveyor 14 so the feed speed is relatively undiminished as the object leaves the conveyor. A bottom edge guide plate 26 is provided adjacent to the diverter plate 22 to provide vertical support to the object 12 as it is diverted from the conveyor 14. The bottom edge guide plate 26 has an upstanding wall 28 and a horizontal floor 30 which combine to guide the object 12 as it moves off the conveyor 14. The floor 30 provides the vertical support. The wall 28 may be curved to accommodate the diverting movement of the object from the conveyor.

Figure 2:
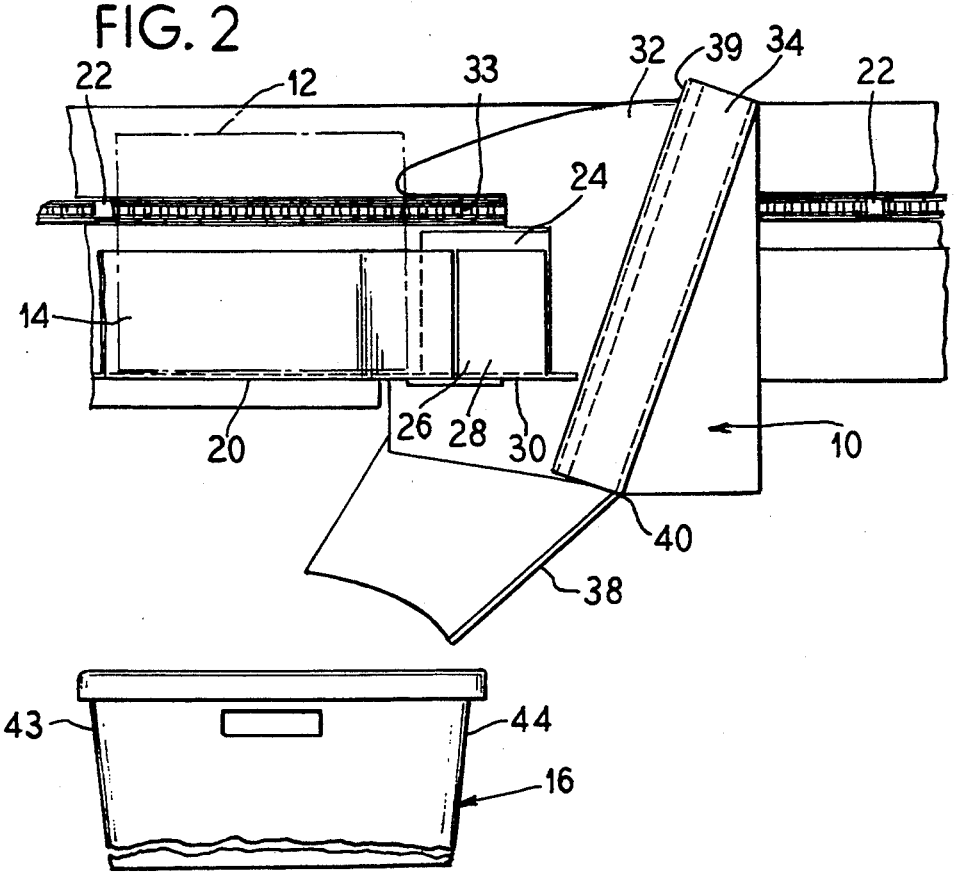
FIG. 2 is a side elevational view of the conveyor and orientation chute of FIG. 1.
Figure 3:
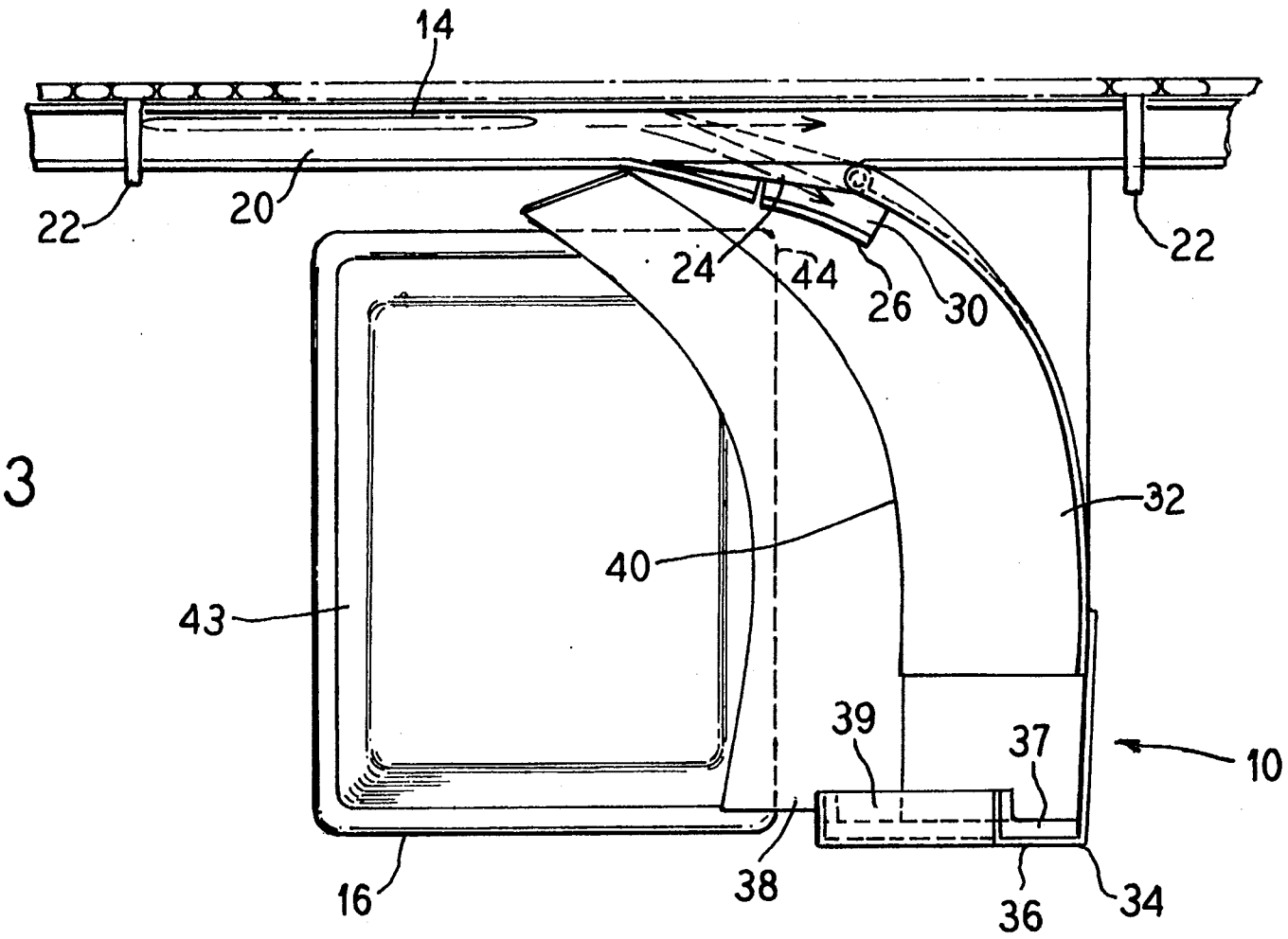
FIG. 3 is a plan view of the conveyor and orientation chute of FIG. 1.

A curved and sloped panel 32 is used to intercept the object 12 as its inertia carries it away from the conveyor 14. Preferably the panel 32 is positioned at an angle from vertical (FIG. 2) so that it will provide both horizontal and vertical support for the object 12. If a shallow angle is selected, centrifugal force will cause the object 12 to rise as it moves horizontally along the panel 32. If a steep angle is selected, gravitational force will overcome the centrifugal force and the object 12 will descend as it moves horizontally along the panel 32. Preferably an angle is selected in which centrifugal and gravitational forces are in balance, thus permitting the object 12 to move horizontally without rising or falling. In early tests, Applicant has preliminarily determined that an angle of approximately 20° provides such a result with certain objects such as magazines and large envelopes.

The current panel 32 extends upwardly above the level of the pusher finger 22 to provide support for the full height of the object 12 being conveyed. Since the finger 22 extends horizontally into the space occupied by the panel 32, a notch 33 is provided in the panel to accommodate passage of the finger past the panel.

A lateral end 34 of the panel 32 is provided with an end stop 36 which projects perpendicularly from the panel a distance greater than the thickness of the objects 12 being conveyed. Although in the preferred embodiment the end stop 36 is a rigid member, in some applications an energy absorbing end stop 37 may be utilized such as a cushion pad or other energy absorbing mechanism. The end stop 36 incorporates a return flange 40 to prevent objects for inadvertently bridging over the end stop.

The curve of the panel 32 does not necessarily have a constant radius in the preferred embodiment. The initial part of the curve matches the angle of the diverter plate 24 in its intercepting position. Preferably the panel has a continuous, but perhaps not constant, curve such that the objects 12, when they reach the end stop 36 are moving approximately perpendicular to the direction of travel they had when they were intercepted on the conveyor 14.

A discharge slide 38 extends from a bottom edge 40 of the curved panel 32 to guide the objects 12 down to the collection receptacle 16. The discharge slide 38 may be a separate member from the curved panel 32 or may be a continuation of that panel. Preferably the slide 38 has a shallower vertical angle than the panel 32 so that the objects 12 will be given a new horizontal velocity as they slide down into the receptacle 16. Thus a bottom edge 41 of the object 12 as it was moving along the conveyor 14 and the curved panel 32 will now become the leading edge as the object moves along the slide 38. The slide 38 causes the objects 12 to change horizontal direction, again preferably by 90° such that the direction the objects move as they enter the collection receptacle 16 is approximately 180° from that which they had when they were moving along the conveyor 14.

In the embodiment illustrated, the receptacle 16 is a flats carrier which is a rectangularly shaped box. The long side 44 of the box 16 is placed perpendicular to the feed path of the conveyor 14 and parallel to an end of the discharge slide 38. The initial bottom and subsequent leading edge of the object 12 will then fall into the box 16 parallel and adjacent to the far long wall 43 of the box.

Figure 4:
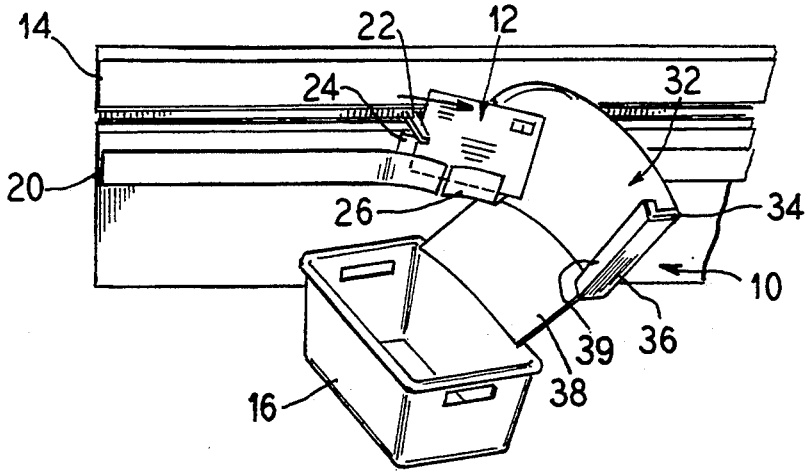
FIG. 4 is a perspective view of the conveyor and orientation chute of FIG. 1 illustrating an object entering the chute.
Figure 5:
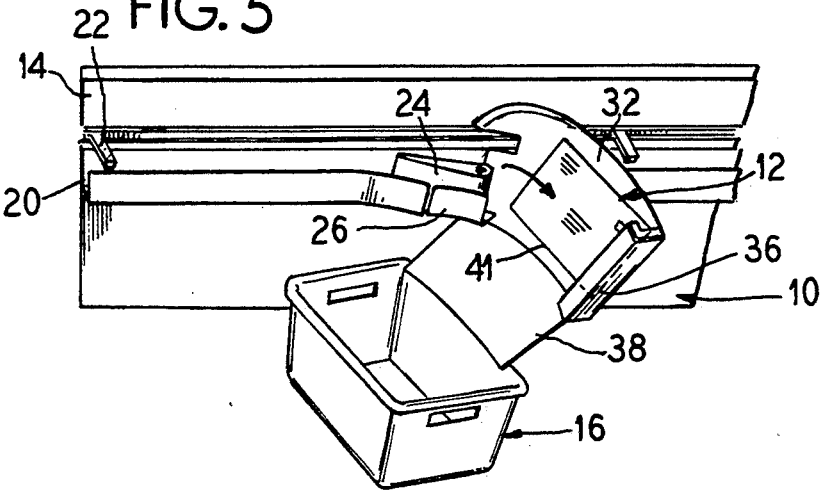
FIG. 5 is a perspective view of the conveyor and orientation chute of FIG. 1 illustrating the object engaging the end stop.
Figure 6:
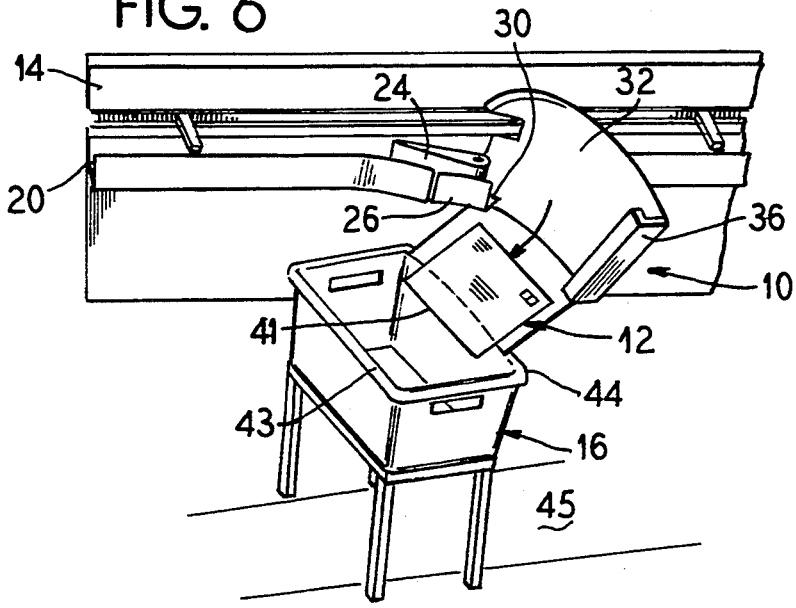
FIG. 6 is a perspective view of the conveyor and orientation chute of FIG. 1 illustrating the object leaving the slide portion of the chute and entering the collection receptacle.

As shown in FIGS. 4, 5 and 6, the sequence of operation is as follows:

In FIG. 4, the diverter plate 24 is rotated into the flow path of the conveyor 14 and a flat 12 is intercepted and diverted onto the bottom edge guide plate 26. At this point, the flat 12 is still being propelled forward at a velocity of 72 inches per second by means of the pusher finger 22 bearing against the trailing edge of the flat. The bottom edge guide plate 26 provides vertical support and guidance for the flat for a predetermined distance, for example, 6 inches, to prevent premature rotation of the flat upon its entry into engagement with the curved panel 32.

In FIG. 5, the flat 12, moving under its own inertia, slides across the polished surface of the curved panel 32 in an attitude that maintains the bottom edge 41 of the flat approximately horizontal. As mentioned above, the curved panel 32 is inclined backwards at an angle of approximately 20° from vertical to minimize the effect of gravitational forces that would normally result in premature rotation of the flat 12 if the curved panel incorporated a steeper incline. The horizontal motion of the flat 12 is stopped when its leading edge impacts the fixed position of the end stop 36 attached to the end 34 of the curved panel 32. In some applications, particularly where more massive objects are being conveyed, or where higher conveying speeds are utilized, i.e. where the momentum of the objects are high, force absorbing means 37 may be used in association with the end stop to assist in rapidly slowing down the object to a stop at the end stop 36.

At the instant of impact with the end stop 36, the velocity of the flat 12 has dissipated to less than 72 inches per second and the attitude of the flat is approximately 90° to the original transport path. The bottom edge 41 of the flat is parallel to a long edge 44 of the receptacle 16 which is located in a fixed position directly below the curved panel 32. If the flats have rotated about a horizontal axis as they move across the curved panel 32, engagement with the end stop 36 will realign or straighten them since impact by a leading corner will cause a counter rotation of the flat into the end stop until the momentum is dissipated. A slight bounce back of certain types of objects upon impact with the end plate 36 is preferred so as not to inhibit the secondary motion of gravity sliding that assures proper orientation of the object stacking in the receptacle 16.

Once the object's inertial horizontal motion has been stopped by the end stop 36, the object gravity falls down the slide 38 with a newly directed slight horizontal motion directly into the receptacle 16 as shown in FIG. 6, and stacks one on top of another in a proper and consistent oriented fashion.

Since the motion of the object 12 as it leaves the conveyor 14 is maintained essentially horizontal until it engages the end stop 36, the collection receptacle can be elevated above the floor 45 by a distance of approximately 20 to 30 inches (when the invention is employed with U.S. postal machines FSM775 or FSM881). This enhances removal of filled boxes either manually (being in an improved ergonometric condition—raised off the floor) or automatically (by allowing for space below the receptacles for an automatic conveying system).

The present invention thus provides enhanced guidance and orientation of items being discharged from a horizontal conveyor without any powered mechanisms and without extensive modifications of an existing conveyor.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An orientation chute for a sorting machine having a horizontal conveyor for transporting objects with substantially linear bottom and leading perimeter edges along a feed path, said orientation chute comprising:

a horizontal support adjacent to said conveyor to vertically support said bottom edge of said objects as they are moved off said conveyor to prevent rotation of said objects;

a curved and sloped panel downstream of said support to vertically and laterally support said objects as they move farther away from said conveyor, said panel being without a surface to engage said bottom edge of said objects, said panel being provided with means for arresting the horizontal movement of said objects and a slide section to direct said objects further downwardly and laterally to a point of collection;

wherein the orientation of each object diverted from said conveyor is manipulated identically between its diversion from said conveyor and its deposit at said point of collection such that all objects will arrive at said point of collection with the same orientation.

2. An orientation chute according to claim 1, wherein said slide section is formed unitarily with said curved and sloped panel.

3. An orientation chute according to claim 1, wherein said slide section is formed separately from, but attached to said curved and sloped panel.

4. An orientation chute according to claim 1, wherein said curved and sloped panel is sloped rearwardly such that centrifugal force and gravitational force are balanced resulting in said objects moving across said panel with a minimum of vertical travel until their horizontal movement is stopped.

5. An orientation chute according to claim 1, wherein said means for arresting the horizontal movement of said objects comprises a rigid wall extending approximately perpendicular to an end of said panel farthest away from said conveyor.

6. An orientation chute according to claim 1, wherein said means for arresting the horizontal movement of said objects comprises a resilient member positioned in the path of said objects moving across said panel to absorb kinetic energy from said objects.

7. An orientation chute according to claim 1, wherein said slide section extends at a shallower vertical angle than said curved and sloped panel.

8. An orientation chute for a sorting machine having a horizontal conveyor for transporting objects along a feed path, said orientation chute comprising:

a transition plate adjacent to said horizontal conveyor to vertically support a bottom edge of said objects as they are moved off said conveyor to prevent rotation of said objects;

a curved and sloped panel downstream of said transition plate to vertically and laterally support said objects as they move farther away from said conveyor, said panel being without a surface to engage a bottom edge of said objects, said panel being provided with an end stop at a lateral position farthest from said conveyor to engage a forward edge of said objects and to arrest the horizontal movement of said objects, and said panel further being provided with a sloped sheet at a horizontal position below said end stop to direct said objects further downwardly and laterally to a point of collection;

wherein the orientation of each object diverted from said conveyor is manipulated identically between its diversion from said conveyor and its deposit at said point of collection such that all objects will arrive at said point of collection with the same relative orientation they had while on the conveyor.

9. An orientation chute according to claim 8, wherein said curved panel and said plate are formed as a unitary member.

10. An orientation chute according to claim 8, wherein said curved panel and said plate are formed as two separate pieces.

11. An orientation chute according to claim 8, wherein said curved panel is sloped rearwardly such that centrifugal force and gravitational force are balanced resulting in said objects moving across said panel with a minimum of vertical travel until they engage said end stop.

12. An orientation chute according to claim 8, wherein said end stop is a rigid wall approximately perpendicular to the end of said panel furthest from said conveyor.

13. An orientation chute according to claim 8, wherein said end stop is provided with energy absorbing means to assist in dissipating the momentum of said objects.

14. An orientation chute according to claim 8, wherein said sloped sheet has a shallower vertical angle than said curved panel.

* * * * *